United States Patent [19]

Butts

[11] Patent Number: 4,768,310

[45] Date of Patent: Sep. 6, 1988

[54] SANDER ATTACHMENT

[76] Inventor: Clifford L. Butts, 2120 Altomont Rd., San Leandro, Calif. 94578

[21] Appl. No.: 59,039

[22] Filed: Jun. 8, 1987

[51] Int. Cl.[4] ..... B24B 21/00

[52] U.S. Cl. ..... 51/141; 51/170 MT; 51/170 TL

[58] Field of Search ..... 51/170 TL, 170 MT, 141, 51/142, 262 R, 391, 392; 428/358, 409

[56] References Cited

U.S. PATENT DOCUMENTS

| | | | |
|---|---|---|---|
| 2,195,340 | 3/1940 | Potash | 51/142 |
| 3,452,734 | 7/1969 | Cleland et al. | 51/148 |
| 3,755,972 | 9/1973 | Mogaki et al. | 51/170 MT |
| 4,510,718 | 4/1985 | Eichenlaub | 51/141 |
| 4,621,459 | 11/1986 | Stump et al. | 51/141 |

*Primary Examiner*—Frederick R. Schmidt
*Assistant Examiner*—Maurina Rachuba
*Attorney, Agent, or Firm*—Alvin E. Hendricson

[57] ABSTRACT

A removable sander attachment is formed as a flat plate with upstanding sides and a limited length for fitting under the forward portion of a belt of sandpaper or the like on a portable vibrating or oscillating sander with the sides of the attachment engaging the sides of the sander cushion to provide a short or limited sanding surface for sanding small areas of extended surfaces.

6 Claims, 1 Drawing Sheet

SANDER ATTACHMENT

The present invention provides a removable attachment for providing only a limited sanding surface on a conventional elongated vibrating or oscillating sander.

BACKGROUND OF INVENTION

Power driven hand held sanders are widely employed in a variety of different fields and are generally separated into rotary sanders and vibrating sanders, that may in turn be subdivided into straight line movements and oscillating movements. In the field of automative body work, for example, rotary sanders are often employed to remove paint and sometimes to smooth metal. It is, however, felt by many in the field that rotary sanders tend to produce scalloped surfaces so that vibrating sanders are preferable.

Considering hand held or portable vibrating sanders, it is noted that they are conventionally powered by electricity or compressed air and may be obtained commercially in a variety of sizes. One conventional large straight line sander has a length of about eighteen inches and a width of three inches with a stroke of about one inch. Again referring to auto body repair, it is noted that a large sander is commonly employed to minimize the time required for sanding operation and yet for small dents or chips a large sander sands surfaces that were undamaged so that extensive subsequent refinishing is required. While it is possible for a workman to switch between large and small sanders, it is unhandy and time consuming to do so. It would thus be advantageous to provide a vibrating sander having the capabilities of both a large and small sander while yet producing the smooth surface characteristic of vibrating sanders.

The present invention provides an attachment for vibrating sanders for converting a large sander to a small sander almost instantaneously.

SUMMARY OF INVENTION

The present invention provides an attachment or removable addition to a vibrating or vibratory hand held power driven sander for rapidly and easily changing the operative sanding surface of the sander. A strip of sandpaper, emery paper or other abrasive coated strip of cloth, paper or the like is normally removably attached at the front and back of a vibrating sander in extension along a resilient sander pad or cushion on the bottom of the sander. The sanding strip is held relatively tightly against the sander cushion. Thus as the sander is brought into contact with the surface of a work piece the sanding strip abrades the surface over at least the length of the sander.

There is provided by the present invention an insert or attachment in the form of a slightly resilient pad of limited length and having upstanding side rails spaced apart a distance equal to the width of the sander cushion. This attachment of the present invention is adapted to be fitted onto the underside of the sander above the sandpaper or sanding strip so as to grip the sander cushion and remain in longitudinally fixed relation to the sander. Preferably, the attachment hereof is positioned adjacent to the front of the sander and is provided with a sufficient thickness to space the sanding strip from the sander cushion. This then reduces the operative sanding surface of the sander when the sander is properly used by placing the sanding surface thereof flat upon the surface of a workpiece.

The attachment of the present invention may be readily inserted between the sanding cushion and sandpaper and just as easily removed to provide an almost instantaneous change over between large and small sanding surfaces.

BRIEF DESCRIPTION OF DRAWINGS

The present invention is illustrated as to a preferred enbodiment thereof in the accompanying drawings, wherein.

DESCRIPTION OF PREFERRED EMBODIMENT

Figure 1:
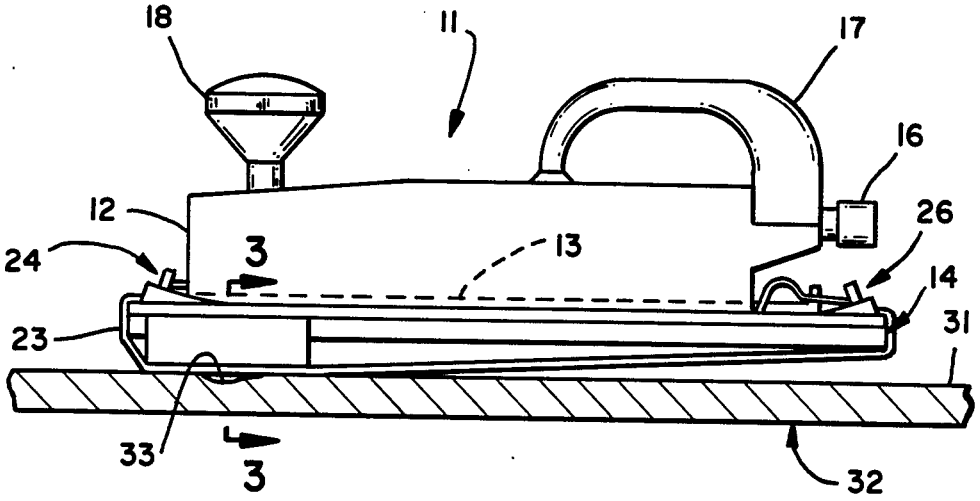
FIG. 1 is a side elevational view of the present invention in engagement with a vibratory hand sander.

The present invention provides an attachment for hand held vibrating sanders which operate to move a bed longitudinally or in an orbital path. The invention is herein illustrated and described in connection with a sander having a longitudinally movable bed and driven by compressed air, as illustrated in FIG. 1 of the drawings. It is noted that such a sander 11 is intended to be employed with the undersurface thereof parallel to and contacting the surface of workpiece. Such a sander is not intended to be employed in tilted or tipped position. It is in this intended position of use of a sander that the present invention is particularly applicable, as discussed below.

Referring further to the drawing, there will be seen to be shown a sander 11 having a top portion 12 engaging a rail or slide plate 13 carrying a depending bed 14, and including a compressed air connector 16 for driving the bed 14 back and forth longitudinally of the upper portion 12 of the sander. Such a sander is quite conventional and normally includes a top handle 17 at the rear of the top portion 12 with a hand hold 18 extending upwardly from the front end of the top portion 12. The bed 14 includes a plate 21 secured to the underside of the rail 13 and having a cushion or pad 22 secured to the underside of the plate. This cushion or pad 22 may be formed of a limitedly resilient material such a relatively hard rubber or the like.

Provision is made for attaching sandpaper, emery paper or other types of abrasive strips 23 to the underside of the sander bed 14. The sandpaper strip 23 is removably attached to the sander as by means of clamps 24 and 26 disposed at the front and rear of the sander bed 14 atop same. The sandpaper strip 23 thus extends from the clamp or the like 24 above the bed at the front thereof, underneath the bed along the underside of the pad or cushion 22 and upwardly into engagement with the rear clamp 26 atop the rear of the bed 14. The sander may be readily employed by gripping the handle 17 and hand hold 18, and turning the sander on to vibrate or move the bed 14 back and forth longitudinally of the sander. The sander is then placed against a surface 31 of a workpiece 32 with the entire length and width of the sandpaper 23 engaging such surface 31. The sander may be moved along the surface 31 parallel to and contacting same as, for example, to remove material from the surface so as to smooth out a dent or depression therein, such as illustrated at 33.

Sanders such as described above have long been employed for a variety of applications including wood working, and body repair for automotive vehicles.

Figure 2:
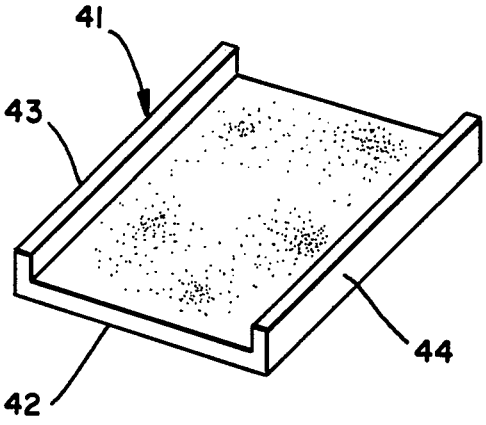
FIG. 2 is perspective view of the attachment of the present invention.
Figure 3:
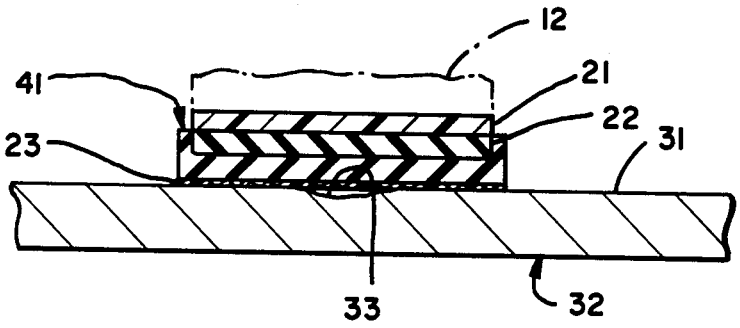
FIG. 3 is a partial sectional view taken in plane 3—3 FIG. 1.

While such sanders are highly advantageous in providing a resultant smooth surface after sanding of same, it is noted that in certain application it may be desired only to sand a small portion of a surface of a workpiece such as in the situation illustrated in FIG. 1, wherein only a small depression in the surface is to be smoothed out or removed by abrading material thereabout. The present invention provides an attachment for such a sander wherein only a limited portion or length of the sandpaper strip 23 is operable during a sanding operation. Such an attachment is illustrated at 41 of FIG. 2, and the engagement thereof with the sander is illustrated in FIGS. 1 and 3. The attachment 41, which is some times termed a fender pad because it is commonly employed for sanding operations upon fenders of automobiles, will be seen to be comprised as a U-shaped element having a flat bottom sheet or plate 42 with upstanding sides or rails 43 and 44. The bottom and side of the unit 41 are preferably integrally formed of a slightly resilient material, such a hard rubber or plastic and the upper surface of the bottom plate or sheet 42 may be roughened or otherwise formed to grip the under surface of the sander cushion or pad 22. The unit 41 is particularly dimensioned with the sides or rails 43 or 44 being spaced apart a distance equal to the width of the sander pad 22, and these sides or rails 43 and 44 extend upwardly from the bottom 42 a distance at least equal to the thickness of the sander pad 22. In addition, the length of the unit 41 is limited to about one quarter of the length of the sander bed 14. Thus one practical unit 41 has a width between sides of two and five-eighths inches with a length of four and three-eighths inches with the rails or sides 43 and 44 extending upwardly from the upper surface of the bottom 42 about five-eighths of an inch and the thickness of material of the bottom and sides being about three-eighths of an inch. Obviously variation in dimensions are possible, however, it is noted that the width between sides is to be equal to the width of the bed of the sander and the length of the unit is to be substantially less then the length of the bed of the sander.

In use, the attachment or fender pad 41 is slipped between the sandpaper strip 23 and the cushion 22 on the bed of the sander into the position illustrated in FIGS. 1 and 3. The unit or fender pad is located at the front of the sander bed with the sides or rails 43 and 44 extending upwardly against at least the sides of the cushion or pad 22 of the sander bed. Insertion or attachment of the unit 41 may be readily accomplished with the sanding strip 23 having a small slack therein so that, with the unit attached, the sanding strip 23 is drawing tightly across the underside of the unit 41 and thence slants upwardly to the rear of the sander, as illustrated in FIG. 1. In this position, as shown, the unit 41 is firmly attached to the sander and provides a limited length of sanding strip 23 along the bottom of the unit with the strip then tappering upwardly to the rear of the sander. This then provides a limited sanding surface along the bottom of the unit 41, so that the sander may be employed to sand or abrade relatively small surfaces without sanding or abrading adjacent surface beneath the rear of the sander. As noted above, sanders of this type are intended to be employed with the sanding surface parallel to and resting upon a work surface, and with the sander so position only the sanding strip 23 beneath the unit 41 will engage the work surface.

It will be seen from the foregoing that the present invention provides for rapid changing of the extent of sanding strip that is available for sanding with a sander having a substantial length. The unit or attachment 41 may be readily slipped into engagement with the underside of the sander above the sanding strip 23 to almost instantaneously reduce the effective or operable length of the sander for sanding operations. The unit 41 may be just as easily removed by tilting same and withdrawing the unit from the underside of the sander, so that the sander is then returned to normal length for sanding operations. While the present invention in itself quite simple, the concept of readily and rapidly changing the operative length of the vibratory sander is not at all obvious, and furthermore the advantages of the present invention are quite substantial.

Although the present invention has been described above with respect to a particular preferred embodiment thereof, it will be apparent to those skilled in the art that modifications and variations are possible within the spirit and scope of the present invention, and thus it is not intended to limit the present invention by the precise terms of descriptions or details of illustration.

What is claimed is:

1. A sander attachment for a hand held vibratory sander having an elongated sanding strip extending along the underside of a sander bed and comprising a unit having a length substantially less than length of the underside of a sander bed and a flat bottom plate with upstanding side walls spaced apart a distance equal to the width of the sander bed for insertion between the sanding strip and bed to reduce the operative length of the sanding strip that is parallel to the sander bed.

2. The attachment of claim 1 further defined by said unit having a length of the order of one quarter of the length of said sander bed.

3. The attachment of claim 1 further defined by said side walls extending upward from said bottom plate a distance at least equal to the thickness of a bottom pad on said sander bed.

4. The attachment of claim 1 further defined by the upper surface of said bottom plate having a roughened surface for engagement with the underside of said sander bed to minimize relative movement of said unit and bed during use of said sander.

5. The attachment of claim 1 further defined by said unit being formed with integral bottom and sides of a stiff resiliently deformable material.

6. The combination of a hand held vibratory sander having an elongated movable bed with a sanding strip removably extending over the under surface thereof and a removable attachment having a flat bottom and upstanding sides disposed between said sanding strips and the under surface of said sander bed with said attachment having a length substantially less that the length of said sander bed to provide an operative sanding surface of said sanding strip that is substantially less than the length of said sanding bed.

* * * * *